US009513025B2

(12) United States Patent
Gonzalez

(10) Patent No.: US 9,513,025 B2
(45) Date of Patent: Dec. 6, 2016

(54) DECORATIVE AIR CONDUIT

(71) Applicant: Yorgan Gonzalez, Los Angeles, CA (US)

(72) Inventor: Yorgan Gonzalez, Los Angeles, CA (US)

( * ) Notice: Subject to any disclaimer, the term of this patent is extended or adjusted under 35 U.S.C. 154(b) by 0 days.

(21) Appl. No.: 14/332,799

(22) Filed: Jul. 16, 2014

(65) Prior Publication Data

US 2015/0140921 A1 May 21, 2015

Related U.S. Application Data

(60) Provisional application No. 61/904,854, filed on Nov. 15, 2013.

(51) Int. Cl.
*F24F 13/02* (2006.01)
*F24F 13/068* (2006.01)

(52) U.S. Cl.
CPC ..... *F24F 13/02* (2013.01); *F24F 13/068* (2013.01); *F24F 13/0227* (2013.01)

(58) Field of Classification Search
CPC ..... F24F 13/068; F24F 13/02; F24F 13/0227
USPC ..... 454/284, 237, 354; 312/107
See application file for complete search history.

(56) References Cited

U.S. PATENT DOCUMENTS 1,542,178 A * 6/1925 Ross ..... F24F 7/08 237/46
2,902,919 A 2/1956 Waalkes et al.
2,814,242 A 11/1957 Marini et al.
3,122,087 A 2/1964 Demuth et al.
4,007,574 A * 2/1977 Riddell ..... E04C 3/20 52/220.2
4,534,147 A * 8/1985 Cristell ..... H02G 3/0431 174/491
5,292,281 A * 3/1994 Butler ..... E04D 13/152 454/260
5,560,168 A * 10/1996 Gagne ..... E06B 3/5892 248/488

(Continued)

FOREIGN PATENT DOCUMENTS

DE 102012003383 A1 * 10/2012 ..... F21S 8/037
NL 1002491 C2 * 9/1997 ..... F24F 13/02

(Continued)

*Primary Examiner* — Steven B McAllister
*Assistant Examiner* — Frances F Hamilton
(74) *Attorney, Agent, or Firm* — Global Intellectual Property Agency, LLC; Daniel Boudwin

(57) ABSTRACT

Described is a decorative air conduit for use with a heating, ventilation, and air conditioning (HVAC) system. The air conduit is an elongated tube having a hollow interior volume through which air can flow. The air conduit preferably has a right triangular cross section such that it can be positioned at or near the intersection of a wall and a ceiling within a room. The air conduit includes apertures spaced at a fixed interval thereon that allow for air to escape the conduit. The apertures can be on an upper surface of the conduit or can be on an outer surface thereof. A decorative molding can be positioned on the outer surface of the conduit and may include apertures thereon. The decorative molding can include various ornamental embellishments, and the decorative molding conceals the air conduit while providing an aesthetically pleasing outward appearance.

7 Claims, 3 Drawing Sheets

(56) References Cited

U.S. PATENT DOCUMENTS

| | | | | |
|---|---|---|---|---|
| 6,918,977 | B1 * | 7/2005 | Maurer | E04F 19/0436<br>156/249 |
| 7,195,556 | B1 * | 3/2007 | Fichtelman | E04D 13/152<br>454/260 |
| 2002/0094773 | A1 * | 7/2002 | Howard | F24F 13/0236<br>454/306 |
| 2003/0140646 | A1 * | 7/2003 | Place | F24F 13/02<br>62/259.2 |
| 2008/0309099 | A1 * | 12/2008 | Torben | E04D 13/0325<br>292/251.5 |
| 2009/0183453 | A1 | 7/2009 | Koessler et al. | |
| 2010/0159817 | A1 * | 6/2010 | Lindgren | E06B 7/02<br>454/211 |
| 2011/0108318 | A1 * | 5/2011 | Pawlak | E04F 19/04<br>174/504 |
| 2013/0025929 | A1 * | 1/2013 | Dower | G02B 6/4459<br>174/502 |
| 2013/0235564 | A1 * | 9/2013 | Barcelos | F21V 33/006<br>362/151 |
| 2015/0143771 | A1 * | 5/2015 | Williams | E04F 19/0463<br>52/716.8 |

FOREIGN PATENT DOCUMENTS

| | | | | |
|---|---|---|---|---|
| NL | 19961002491 | C2 * | 9/1997 | F24F 13/02 |
| PL | WO 2010090540 | A1 * | 8/2010 | F24F 13/02 |

* cited by examiner

DECORATIVE AIR CONDUIT

CROSS REFERENCE TO RELATED APPLICATION

This application claims the benefit of U.S. Provisional Application No. 61/904,854 filed on Nov. 15, 2013, entitled "Crown Molding Fittings." The above identified patent application is herein incorporated by reference in its entirety to provide continuity of disclosure.

BACKGROUND OF THE INVENTION

Field of the Invention

The present invention relates to a decorative air conduit. More specifically, the present invention relates to a conduit having a decorative outer surface resembling a molding, wherein the conduit includes apertures therethrough to allow air to exit said conduit into a room. In this way, the present invention provides an aesthetically pleasing and functional piping system for use with an HVAC system.

Many apartments, offices, and other buildings have heating, ventilation and air conditioning (HVAC) systems. These systems include a plurality of conduits and vents that are disposed throughout a building in order to circulate heated or cooled air to the various rooms of the building. Further, such systems may also serve to filter the air distributed within the system. However, HVAC systems include large metal conduits that are bulky and have an industrial appearance. Further, air vents on the conduits that allow air to escape therefrom may also be aesthetically unpleasing, and detract from the decor of an office or room.

Further, HVAC systems circulate air within a room using one or more air vents. Thus, all of the air fed to a room may be supplied from a single vent, which may result in gusts of air flowing into the room. Further, the single location of the vent may cause a temperature difference between various portions of a single room. Such heating or cooling arrangements are undesirable, and may not efficiently heat or cool one or more rooms.

The present invention provides a decorative air conduit for use with an HVAC system. The decorative air conduit is an elongated tube having a hollow interior volume such that air can flow therethrough. The air conduit preferably comprises a triangular cross section so that it can be positioned at or near the intersection of a wall and ceiling. The air conduit includes a plurality of apertures on a surface thereof that allow air to escape the air conduit. The apertures are spaced at a fixed interval and are preferably rectangular in shape. A decorative molding can be secured to the outer surface of the conduit and conceals the air conduit while providing an ornamental appearance thereto. In embodiments of the invention wherein the apertures on the conduit are on the front or outer surface thereof, the decorative molding further includes a plurality of apertures thereon that align with the apertures on the conduit, so that air can flow from the conduit, through the molding, and into a room. In this way, the present invention provides an air conduit having a decorative outer appearance that conceals the air conduit, and that allows air to be distributed evenly throughout a room.

Description of the Prior Art

Devices have been disclosed in the prior art that relate to air diffusing devices. These include devices that have been patented and published in patent application publications. These devices generally relate to devices that improve air flow or that provide ventilation. The following is a list of devices deemed most relevant to the present disclosure, which are herein described for the purposes of highlighting and differentiating the unique aspects of the present invention, and further highlighting the drawbacks existing in the prior art.

One such device, U.S. Patent Application Publication Number 2009/0183453 to Koessler et al., discloses an apparatus for providing air flow that is installed in a building wall between interior and exterior layers of the building walls. The apparatus includes a hood that projects outward from a base and to the exterior of a wall layer. A venting component is located above the hood and comprises a plurality of apertures for providing ventilation to the interstitial space. The device further includes a lower venting component with apertures thereon for providing additional ventilation. Thus, Koessler fails to disclose a device for use with an HVAC system comprising an air conduit having a decorative molding to improve the aesthetic appearance of the air conduit.

U.S. Pat. No. 2,902,919 to Waalkes et al. discloses a baseboard diffuser to be positioned on the intersection of the floor and wall of a room in order to distribute air into the room for heating or cooling. The diffuser includes an elongated valve member hingedly secured to a rear portion of the diffuser that controls the amount of air that can escape the diffuser. Waalkes discloses an air diffusing device, but fails to disclose an air conduit having a triangular cross section that is adapted to be mounted at or near the intersection of a wall and ceiling.

U.S. Pat. No. 2,814,242 to Marini et al. discloses a hot air diffuser comprising a sheet metal baseboard having a plurality of openings through which hot air can flow. The invention further includes a means for regulating the size of the openings. The hot air distributor includes an exterior finish that resembles conventional wood baseboards in order to present an aesthetically pleasing outward appearance. Thus, Marini discloses a hot air diffuser with a plurality of openings, but fails to disclose an air conduit having a triangular cross section, and does not disclose securing the hot air diffuser along the upper portion of a wall and ceiling of a room.

Finally, U.S. Pat. No. 3,122,087 to Demuth et al. discloses an air diffusing apparatus adapted to distribute air substantially throughout a room and to direct air along a wall or window of a room. The diffuser can be mounted in a ceiling adjacent to a window area and comprises a rectangular shape. A series of adjustable vanes extend between opposing sides of the air diffuser and are used to control the amount and direction of air distributed into the room. Thus, while Demuth et al. discloses an air diffusing apparatus, Demuth does not disclose an air conduit having a triangular cross section that is adapted to be mounted at the intersection of a wall and a ceiling of a room.

These prior art devices have several known drawbacks. Several devices in the prior art relate to air diffusers adapted to distribute air into a room. However, such devices do not have air conduits with triangular cross sections. Conventional conduits having rectangular cross sections jut out into the interior of a room, and create corners that are hard to cover or conceal in an aesthetically pleasing manner. Further, many prior art devices are adapted to be secured along the lower portion of a wall and adjacent to a floor, rather than at the intersection of a wall and ceiling.

In light of the devices disclosed in the prior art, it is submitted that the present invention substantially diverges in design elements from the prior art and consequently it is clear that there is a need in the art for an improvement to existing air conduit devices. In this regard the instant invention substantially fulfills these needs.

SUMMARY OF THE INVENTION

In view of the foregoing disadvantages inherent in the known types of air conduits now present in the prior art, the present invention provides a new air conduit wherein the same can be utilized for providing convenience for the user when distributing air within a home using an HVAC system.

It is therefore an object of the present invention to provide a new and improved decorative air conduit device that has all of the advantages of the prior art and none of the disadvantages.

It is another object of the present invention to provide a decorative air conduit having a decorative outer surface that conceals the conduit and provides an aesthetically pleasing appearance.

Another object of the present invention is to provide a decorative air conduit that can be operably connected to a conventional HVAC system.

Yet another object of the present invention is to provide a decorative air conduit that includes a plurality of apertures thereon for evenly distributing air supplied from an HVAC system into a room or rooms.

A further object of the present invention is to provide a decorative air conduit that includes a triangular shaped conduit that can be easily positioned in the intersection of the wall and ceiling of a room.

Another object of the present invention is to provide a decorative air conduit that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
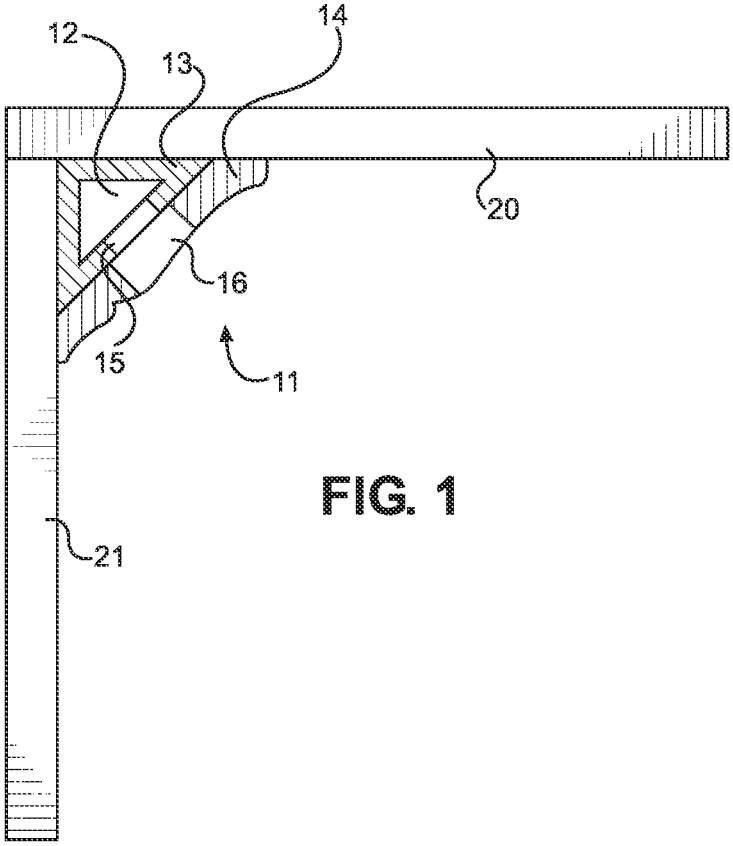
FIG. 1 shows a cross-sectional view of the decorative air conduit of the present invention as installed at the intersection of a wall and ceiling.

Reference is made herein to the attached drawings. Like reference numerals are used throughout the drawings to depict like or similar elements of the decorative air conduit. For the purposes of presenting a brief and clear description of the present invention, the preferred embodiment will be discussed as used for providing air circulation to a room in a discrete and aesthetically pleasing manner. The figures are intended for representative purposes only and should not be considered to be limiting in any respect.

Referring now to FIG. 1, there is shown a cross-sectional view of the decorative air conduit of the present invention. The present invention describes a decorative air conduit 11 comprising an air conduit 13 and a decorative molding 14 that can be secured thereto. The air conduit 13 is an elongated tube having a hollow interior volume 12 in which air can flow, and the air conduit 13 preferably comprises a triangular cross section. More preferably, the cross section of the air conduit 13 is a right triangle. In this way, a first side of the conduit can be placed flush against a wall 21 and a second side of the air conduit 13 can be placed flush against, or adjacent to, a ceiling 20. The side of the air conduit 13 corresponding to the hypotenuse of the triangle extends between the wall 21 and the ceiling 20 and comprises an outer surface that faces the interior of a room. A molding 14 having a decorative appearance can be secured to the outer surface of the air conduit 13. In this way, the air conduit 13 can be conveniently and discretely positioned within a room, while providing an aesthetically pleasing appearance.

The air conduit 13 can be secured to the wall 21 and ceiling 20 using any suitable fasteners commonly used to secure HVAC conduits. For example, the air conduit 13 can be secured to the wall 21 and ceiling 20 using brackets and screws or bolts. Further, the air conduit is adapted to be operably connected to a conventional HVAC system so that air is fed from the HVAC system and into the decorative air conduit 11 of the present invention.

Figure 2:
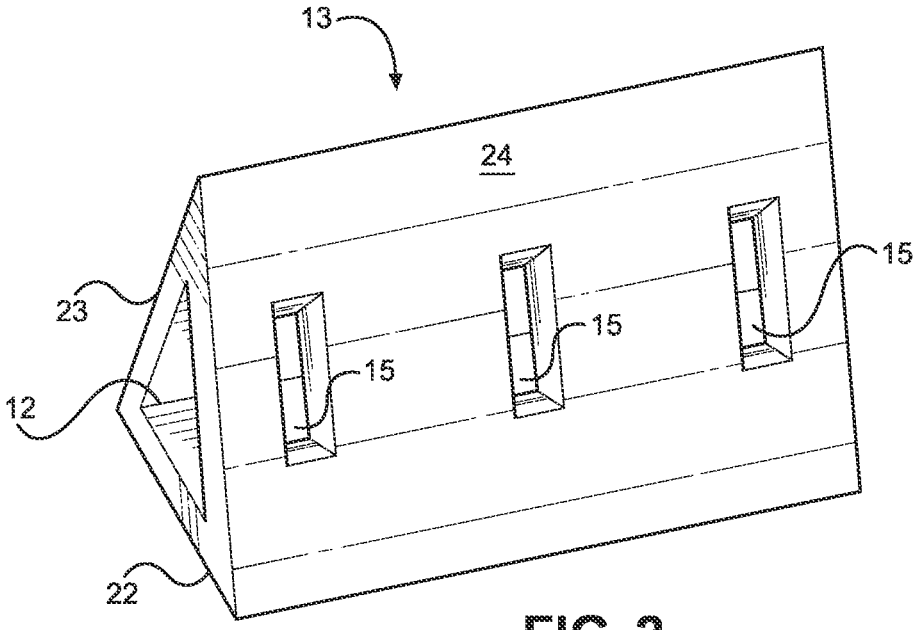
FIG. 2 shows a perspective a view of the air conduit component of the present invention.

Referring now to FIG. 2, there is shown a perspective a view of the air conduit component of the present invention. The air conduit 13 comprises an elongated tube that can be sized to fit within a particular room. The air conduit 13 comprises a first side 22 adapted to be positioned against a wall, a second side 23 adapted to be positioned against a ceiling, and a third side corresponding to the hypotenuse of the triangle having an outer surface 24 that faces into the interior of the room in which the air conduit 13 is positioned.

In the illustrated embodiment, the air conduit 13 comprises a plurality of apertures 15 through the outer surface 24 thereof. The apertures 15 can comprise a variety of shapes, and are preferably rectangular in shape. Further, the apertures 15 are preferably spaced at a fixed interval and are arranged in a linear configuration. This allows air within the air conduit 13 to flow outward therefrom so as to be distributed evenly within a room. Thus, the present invention provides an improvement over conventional HVAC systems which generally include only one or two vents from which all of the air within the conduit is released. As a result, conventional HVAC systems may produce a temperature gradient in a room, such that some portions of the room are warmer or colder than others.

Figure 3:
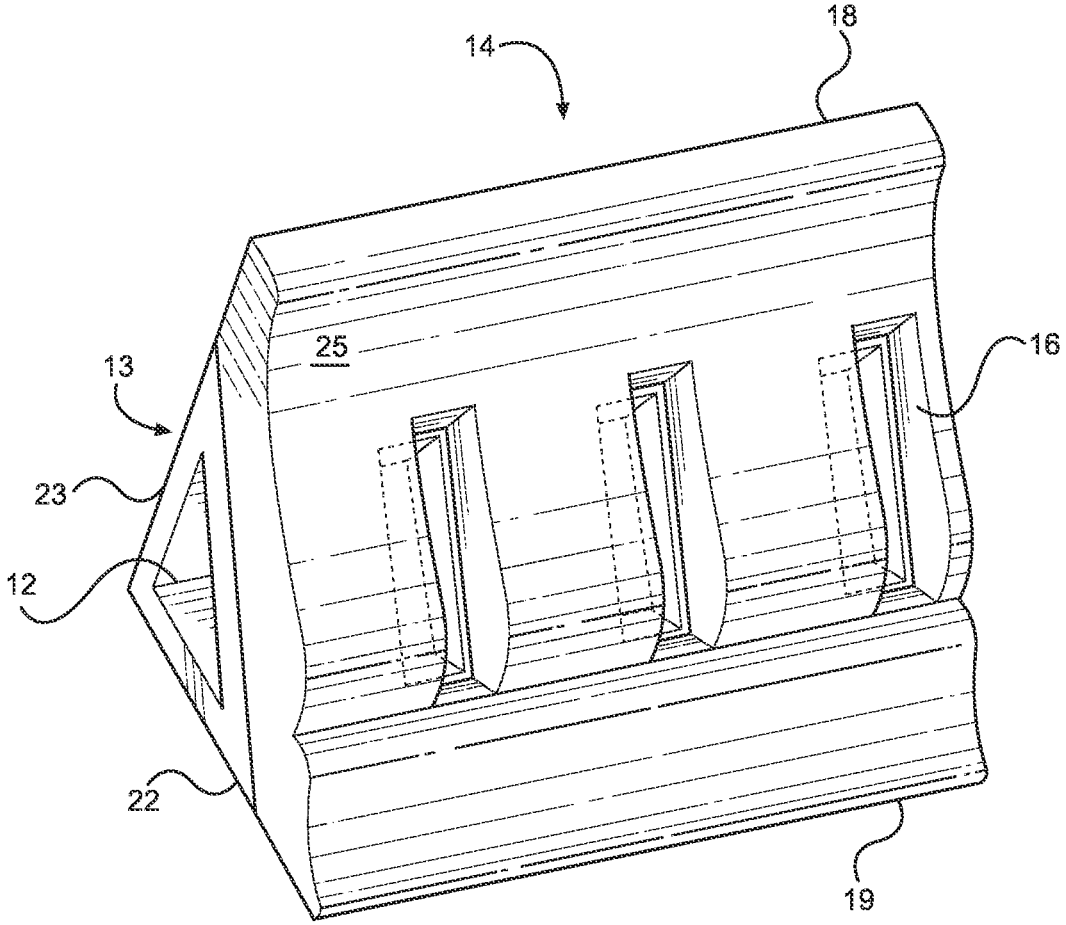
FIG. 3 shows another perspective view of the air conduit of the present invention having a decorative molding thereon.

Referring now to FIG. 3, there is shown a perspective view of an air conduit of the present invention having a decorative molding thereon. The decorative molding 14 can be positioned flush against the outer surface of the air conduit 13. The decorative molding 14 can be secured thereto using any suitable fastening means, such as adhesives. The decorative molding 14 has a first end 18 to be positioned adjacent to a ceiling, and a second end positioned adjacent to a wall 19. The decorative molding 14 may have any of a variety of ornamental embellishments 25 thereon to improve the appearance of the molding 14. In the illustrated embodiment, the decorative molding 14 further comprises a plurality of apertures 16 thereon that are separated at a fixed interval. The plurality of apertures 16 on the molding 14 are positioned so as to align with the plurality of apertures on the air conduit 13. In this way, air from within the conduit 13 can flow outward through the apertures thereon and through the apertures 16 on the molding 14 so as to allow air to pass into a room.

Figure 4:
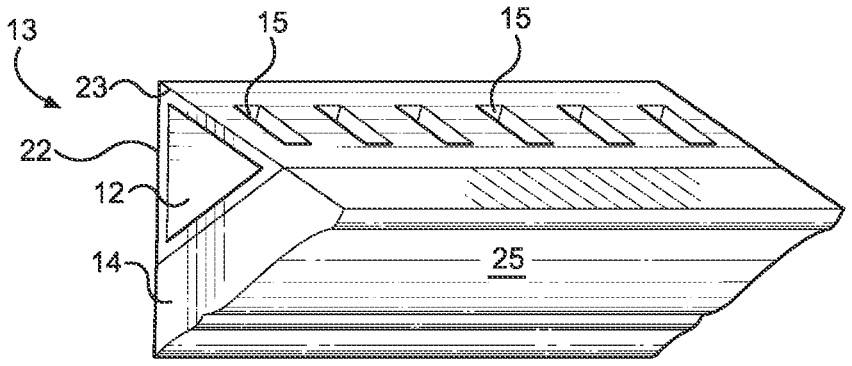
FIG. 4 shows a perspective view of an embodiment of an air conduit of the present invention having apertures on an upper surface thereof.

Referring now to FIG. 4, there is shown a perspective view of an embodiment of the air conduit of the present invention having apertures on an upper surface thereof. The air conduit 13 of the present invention comprises a triangular cross section, and more preferably a right triangular cross section. A first side 22 of the air conduit 13 is adapted to be positioned against a wall, and a second side 23 is adapted to be disposed parallel to or adjacent to a ceiling. In the illustrated embodiment, the second side 23 of the air conduit 13 includes a plurality of apertures 15 thereon that are spaced at a fixed interval. Preferably, the apertures 15 comprise a rectangular shape, however, various other shapes may be used. In this way, the apertures 15 allow air within the interior volume 12 of the conduit 13 to flow outward therefrom and towards the ceiling of the room. This prevents air from blowing directly into the interior of the room, creating an undesirable draft or gust. In the illustrated embodiment, the decorative molding 14 can be secured to the exterior surface of the air conduit 13 using any suitable fastener, such as adhesives, in order to conceal the air conduit 13 and provide a decorative appearance. The decorative molding 14 in the illustrated embodiment is substantially solid, and does not include apertures thereon.

Figure 5:
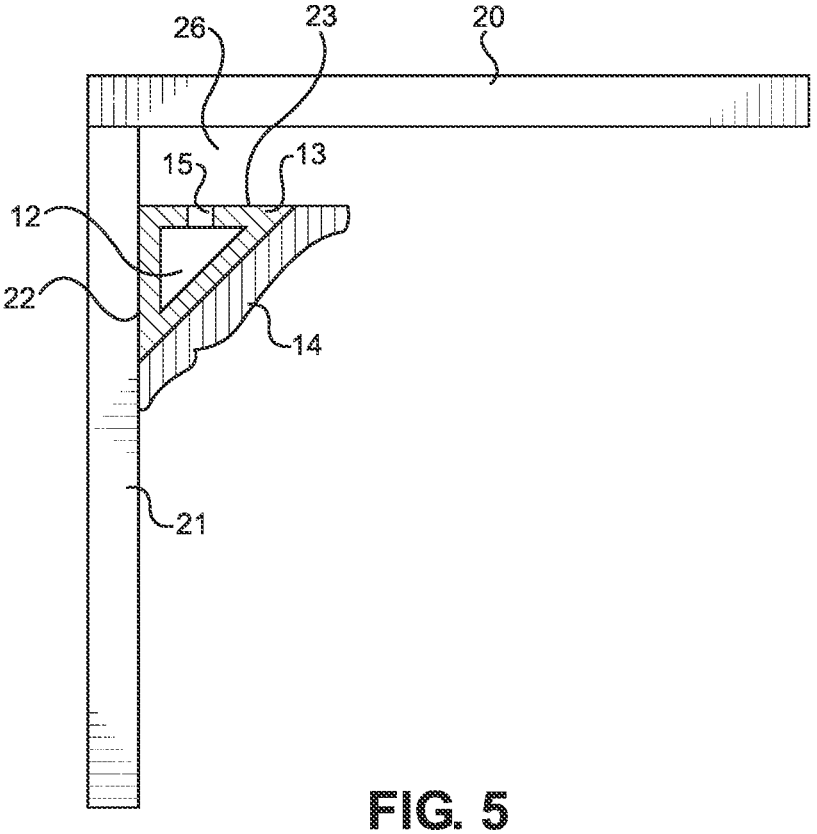
FIG. 5 shows a cross sectional view of an embodiment of an air conduit of the present invention having apertures on an upper surface thereof.

Referring now to FIG. 5, there is shown a cross sectional view of an alternate embodiment of the decorative air conduit of the present invention having apertures on an upper surface thereof. The first side 22 of the air conduit 13 can be positioned and secured such that it is flush against a wall 21. The air conduit 13 is positioned such that there is a space 26 between the second side 23 or upper surface of the air conduit 13 and the ceiling 20. The second side 23 includes apertures 15 thereon that allow air within the air conduit 13 to escape therefrom. Thus, the space 26 allows the air within the air conduit 13 to escape therefrom, and flow into the room. The apertures 15 cause the air to flow upwards and towards the ceiling 20, preventing the air from blowing directly into the interior of the room. The decorative molding 14 can be secured to the outer surface of the air conduit 13 so as to provide a decorative appearance to the air conduit 13.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air conduit assembly, comprising:

an elongated tubular conduit having a hollow interior, wherein said conduit is adapted to be connected to an HVAC system;

wherein said conduit comprises a cross section having a triangular shape;

wherein a first side of said conduit is adapted to be positioned against a wall, a second side of said conduit is adapted to be positioned adjacent to or against a ceiling, and an outer side adapted to extend between said wall and said ceiling;

wherein said conduit comprises a plurality of apertures disposed on the outer side thereof;

a stationary decorative molding adapted to be secured to said outer side of said conduit;

the stationary decorative molding comprising a plurality of apertures, the plurality of the stationary decorative molding configured to align with the plurality of apertures of the conduit.

2. The air conduit assembly of claim 1, wherein said plurality of apertures on said stationary decorative molding are rectangular in shape.

3. The air conduit assembly of claim 1, wherein said cross section of said conduit comprises a shape of a right triangle.

4. The air conduit assembly of claim 1, wherein said plurality of apertures on said conduit comprise a rectangular shape.

5. The air conduit assembly of claim 1, wherein said plurality of apertures on said conduit are spaced at a fixed interval.

6. The decorative air conduit assembly of claim 1, wherein said stationary decorative molding comprises ornamental embellishments thereon.

7. The air conduit assembly of claim 1, wherein said stationary decorative molding is secured to said conduit by means of an adhesive.

* * * * *